United States Patent [19]

Greene et al.

[11] 4,406,229

[45] Sep. 27, 1983

[54] DELAY CARTRIDGE WITH TEMPERATURE PROGRAMMED FLASH CHAMBER

[75] Inventors: Michael L. Greene, Oxon Hill; Frank J. Valenta, LaPlata, both of Md.

[73] Assignee: The United States of America as represented by the Secretary of the Navy, Washington, D.C.

[21] Appl. No.: 244,380

[22] Filed: Mar. 16, 1981

[51] Int. Cl.[3] ..... F42B 5/20

[52] U.S. Cl. ..... 102/530; 102/204

[58] Field of Search ..... 102/204, 275.1, 275.13, 102/269, 202.13, 530, 531

[56] References Cited

U.S. PATENT DOCUMENTS 3,352,237 11/1967 Turquois ..... 102/202 B 3,851,586 12/1974 Eller et al. ..... 102/275.1

*Primary Examiner*—Harold J. Tudor

[57] ABSTRACT

An improved pyrotechnic delay system wherein temperature compensation means are utilized to minimize or eliminate ambient temperature affects upon the burning rate and variability of the delay. Apparatus and method are provided to increase the accuracy of cartridges employing pyrotechnic delay compositions by decreasing differences in composition burning time between extreme ambient temperatures. In the apparatus and method a flash chamber is programmed to increase in volume during initiation of the delay column at elevated temperatures to increase the accuracy of cartridges employing pyrotechnic delay compositions.

9 Claims, 4 Drawing Figures

DELAY CARTRIDGE WITH TEMPERATURE PROGRAMMED FLASH CHAMBER

BACKGROUND OF THE INVENTION

Delay cartridges that employ pyrotechnic delays are used to sequence and operate aircrew escape systems. The capability of a cartridge to deliver energy at a programmed delay time after an initiation stimulus determines whether or not a pilot shall successfully eject from an aircraft in an emergency. A given delay cartridge lot qualified at −65° F. and +200° F. temperature will have a lower and upper $3\sigma$ limit on delay time at each temperature. The time span between the lower $3\sigma$ limit at +200° F. and the upper $3\sigma$ limit at −65° F. comprises a statistical delay time envelope in which the delay times of cartridges from the qualified lot will fall.

Conventional delay cartridges generally include: case; percussion primer; flash chamber; a delay body, plug, or housing, surrounding the pyrotechnic delay column of suitable composition and an igniter composition for igniting the delay column; a transfer charge; a propellant output charge; and closure disc. During burning, heat is continually being transferred to the delay body from the delay column since the delay column reaction is highly exothermic while the delay body is at a much lower temperature, thus acting as a heat sink. In most situations, this heat transfer to the delay body slows the burning rate of the delay column and alters the predictability of the time delay. Although attempt to utilize delay bodies fabricated from low thermal conductivity materials have been made in the past, marginal improvement in the statistical delay time envelope between the extreme temperatures have been achieved. Moreover, materials with low thermal conductivities are difficult to utilize as delay bodies.

Most pyrotechnic delay compositions are less temperature dependent at higher ambient temperatures. In other words, a change in temperature when the ambient temperature is high will produce a smaller change in delay burn time than a temperature change occurring at a lower ambient temperature. Therefore, performance of the delay could be enhanced by providing an elevated-temperature environment during delay column reaction. The teachings of U.S. Pat. No. 3,851,586 issued Dec. 3, 1974 show how to minimize or eliminate ambient temperature effects upon the burning rate and variability of the delay. Here, the pyrotechnic delay column is surrounded with a volume of material that is easily ignited, high-heat producing, and fast burning relative to the burning rate of the delay column. Heat released by this material heats the body of the delay system, creating an elevated temperature environment for the delay column which is desirable to enhance the predictability of the delay variable and to minimize adverse effects of the actual ambient temperature. However, the use of pyrotechnic heating in a delay cartridge to condition the delay column to higher temperature results in increased pressure and higher temperature in the flash chamber, the enclosed chamber in a delay cartridge that is formed in the internal cylindrical spaces of the cartridge casing between the percussion primer and the delay plug with its delay column. The delay time of the delay cartridge is strongly dependent upon the temperature and pressure in the flash chamber. These parameters affect burn rate directly and through diffusion of combustion products from the flash chamber into the unburned delay column. The volume of the flash chamber is most important, because it is reflected in flash chamber pressure and temperature. Unfortunately, the resulting increased pressure and temperature in the flash chamber with ambient temperature from pyrotechnic heating degrades the desired temperature compensation benefits.

Special formulations of the delay ingredients, especially with regard to heavy metal soaps, are provided by the teachings of U.S. Pat. No. 3,726,730 issued Apr. 10, 1973. Although these formulations have met with limited success, formulation of these delays to the exact specifications that produce the desirable properties is hard to duplicate.

The apparatus and methods disclosed in this application extend the delay time at elevated temperatures, since a delay column normally takes less time to burn at high temperatures than at low temperatures. Thereby the statistical delay time envelope is reduced and the overall delay accuracy of the cartridge is increased.

SUMMARY OF THE INVENTION

Accordingly, one object of the invention is to provide an improved pyrotechnic delay cartridge that is more reliable by increasing flash chamber volume at elevated temperatures.

Another object of this invention is to provide an improved pyrotechnic delay cartridge wherein flash chamber volume control is used to minimize the statistical delay time envelope of delay cartridges from a qualified lot.

Another object of the invention is to provide an improved pyrotechnic delay cartridge equipped with means for decreased flash chamber volume at low temperatures to increase burning rates of the delay column to improve reliability.

A still further object of the invention is to provide an improved pyrotechnic delay equipped with a passive mechanism that automatically adjusts flash chamber volume of the cartridge as a function of ambient temperature.

An additional object of the invention is to provide an improved pyrotechnic delay mechanism and cartridge wherein flash chamber volume is increased at elevated temperatures and internal pressure is decreased with a corresponding decrease in delay burning rate.

It is still a further object of the invention to provide a delay cartridge mechanism wherein the flash chamber volume is minimal at low temperature and the delay burning rate is increased by high internal pressure.

It is still a further object of the invention to provide an improved and more reliable pyrotechnic delay mechanism utilizing a fusible eutectic alloy that acts as a switching means and temperature sensor.

BRIEF DESCRIPTION OF THE DRAWINGS

A more complete appreciation of the invention and many of the attendant advantages thereof will be readily appreciated as the same becomes better understood by reference to the following detailed description when considered in connection with the accompanying drawings wherein.

DESCRIPTION OF THE PREFERRED EMBODIMENTS

Figure 1:
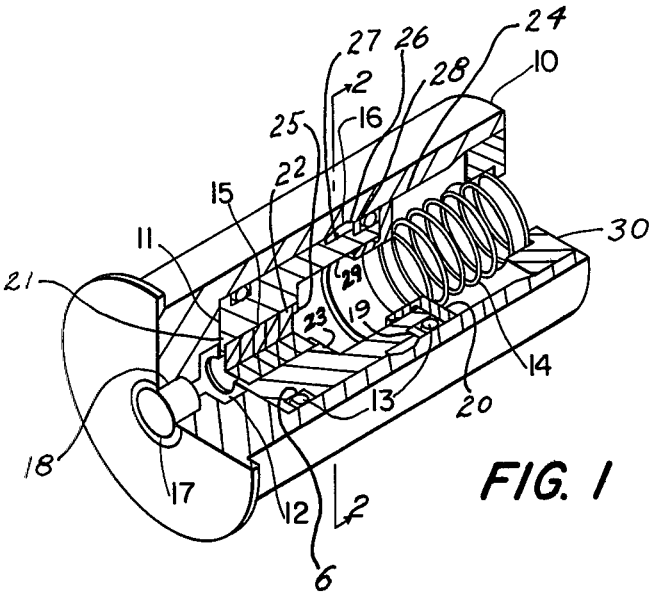
FIG. 1 represents a partial cut away view of delay cartridge with temperature programmed flash chamber.

Referring now to the drawing wherein like reference characters designate identical or corresponding parts throughout the several views and more particularly to FIG. 1, thereof a complete delay cartridge with a temperature programmed flash chamber is shown. A pyrotechnic delay column 15 is pressed within the central bore 22 of delay plug 11. An ignition increment is usually pressed at the head end of the delay column and a transfer increment is pressed on the output end of the delay column, but have been omitted here for clarity. A retaining ring 25 seats on the output end of delay column 15 within bore 22. Retaining ring 25 is "staked" in place by application sufficient pressure to shoulder 23, which is adjacent to bore 22, to produce constriction of said bore opening about the outer diameter of said retaining ring. O-ring 13 is placed in annular groove 6 before delay plug 11 is inserted into central bore 24 of outer casing 10 and biased against shoulder 21 of said casing. A flash chamber 12 is formed in the cylindrical spaces between percussion primer 17 and delay plug 11 with its delay column 15. Percussion primer 17 is fitted into aperture 18 with sufficient force to form an air tight seal. Moreover, pressures developed within percussion primer 17 will tend to expand the cylindrical case of said primer against aperture 18 to form a high pressure seal. O-ring 13 in annular groove 6 prevents gases from escaping between the outside diameter of plug 11 and bore 24 of outer casing 10.

Figure 2:
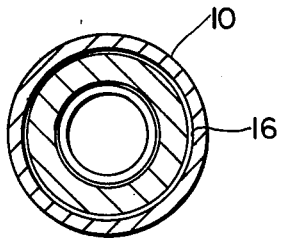
FIG. 2 is a cross sectional view along lines 2—2 of FIG. 1.

A fusible eutectic alloy is flowed into annulus 16, also shown in FIG. 2, formed between: relief 26 in bore 24 of outer casing 10; relief 27 on the outer diameter of delay plug 11; and backup ring 28 that fits against shoulder 19 of delay plug 11. A second O-ring 13 to contain the fusible eutectic alloy is positioned on the diametrical end surface of delay plug 11 and a retaining collar 20 is press fitted into aperture 29 of delay plug 11. Biasing spring 14, that is positioned between delay plug 11 and retaining cap 30, prevents movement of the delay plug 11 resulting from vibration or changes of ambient pressure, either external to the delay cartridge or within the flash chamber 12, when the fusible eutectic alloy is in the fluid state. A propellant charge with closure means would normally be housed at the output end of the delay column.

A cold temperature ignition is best shown in FIG. 1 when the contained fusible eutectic alloy is annulus 16 forms a solid retaining ring to keep delay plug 11 with its pyrotechnic delay column 15 in place. The volume of flash chamber 12, which is sized to produce high temperatures and pressures, is almost unchanged as gases build up in response to pressures created by the initiation of percussion primer 17 and gassing of the ignition and delay composition 15. The high internal pressure and temperature increase the delay column burning rate and thereby produce shorter delay times at low ambient temperatures.

Figure 3:
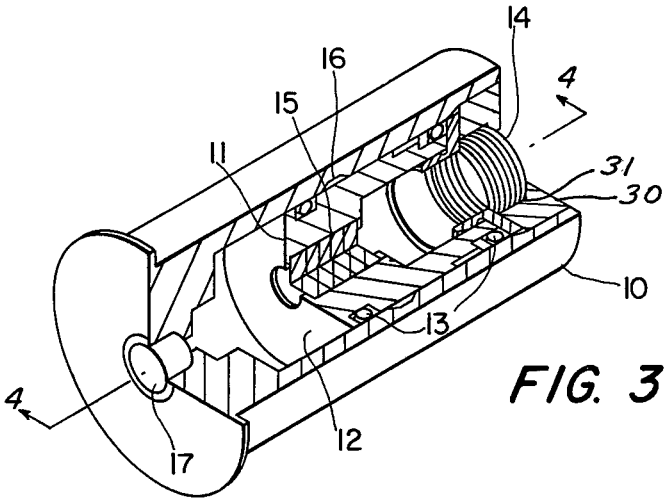
FIG. 3 is a partial cut away view of delay cartridge after high temperature firing.
Figure 4:
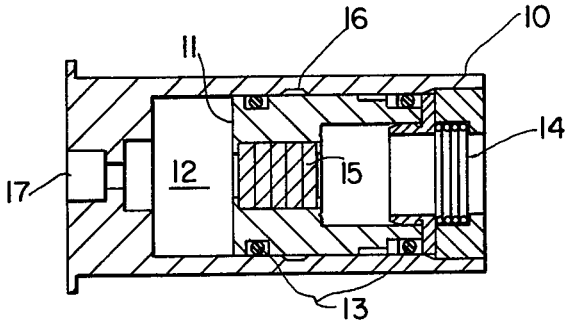
FIG. 4 is a cross sectional view along lines 3—3 of FIG. 3.

An elevated temperature ignition is best shown in FIG. 3 and FIG. 4. Here, the contained fusible eutectic alloy liquates with increased ambient temperature. When gases build up in response to pressure created by the initiation of percussion primer 17 and gassing of the ignition and delay composition 15 at elevated temperature, the pressure developed in flash chamber 12 will provide sufficient force to slide delay plug 11 with its pyrotechnic delay column 15 in central bore 24 of outer casing 10 longitudinally and rearwardly with respect to the flash chamber 12. Biasing spring 14 will be compressed into aperture 31 of retaining cap 30 and flash chamber 12 will increase greatly in volume. By increasing flash chamber volume at elevated ambient temperatures, temperature and pressure in the flash chamber are decreased and delay burning rate is correspondingly decreased. Normally the pyrotechnic delay compositions will burn much faster at the high ambient temperature when the flash chamber volume remains constant. This overall effect, changing the flash chamber volume of the cartridge at the extreme qualification temperatures, is to reduce the statistical delay time envelope in which the delay times of cartridges from the qualified lot will fall.

The delay plug 11 was designed to locate the annulus for the fusible eutectic alloy away from the exothermic delay column. The intention is to minimize the affect of cartridge generated heat on the fusible eutectic alloy when in the solid state. At the delay times examined (approximately one second) there was no observed thermal affects other than that expected from the ambient temperature (i.e., the response time for the fusible eutectic alloy at −65° F. was greater than one second).

The fusible eutectic alloy, Metco Low 117 (m.p. 117° F.), which was successfully tested in the teachings embodied, is composed of:

| | Metco Low 117 |
|---|---|
| Bismuth | 44.7% |
| Lead | 22.6% |
| Indium | 19.1% |
| Tin | 8.3% |
| Cadmium | 5.3% |

No compatibility problems with Metco 117 were observed during loading and testing. However, long term compatibility of liquid and solid metals in intimate contact may produce embrittlement problems.

The cartridges were loaded with 125 mg ignition/input and transfer/output increments of AIA ($Zr/Fe_2O_3/SiO_2$). The delay column was loaded with three increments of manganese delay of the following compositions:

| | |
|---|---|
| Mn | 36.6% |
| $PbCrO_4$ | 42.4% |
| $BaCrO_4$ | 21.0% |

All increments were pressed at 30,000 psi. Cartridges were temperature conditioned/fired in a test fixture that minimized uncontrolled thermal effects.

To those skilled in the art, many modifications and variations of the present invention are possible in light of the above teachings. It is therefore to be understood that the present invention can be practiced otherwise than as specifically described herein and still be within the spirit and scope of the appended claims.

What is claimed as new and desired to be secured by Letters Patent of the United States is:

1. A temperature compensated pyrotechnic delay cartridge system comprising:

a casing that consists of a container with one open end and one end closed by a percussion primer means;

a delay plug means positioned in the open end of the casing and is axially movable within the casing; with associated means to restrain the delay plug within the casing and, a flash chamber of variable volume formed in the casing;

a pyrotechnic delay column secured axially within the delay plug means; a percussion primer means secured axially within the closed end of the casing, with spring means positioned contiguous to the delay plug that functions to bias the delay plug within the chamber toward said closed end of the casing and wherein the delay plug is fitted with automatic means to constrain said delay plug means to inhibit axial movement of the plug within the casing at lower ambient temperatures to maintain the flash chamber volume at a minimum after ignition and said automatic means releasing said delay plug means after ignition to allow axial movement of the plug within the casing at elevated ambient temperatures to increase the flash chamber volume.

2. The temperature compensated pyrotechnic delay system of claim 1 wherein the automatic means comprises a metal alloy ring used to constrain the plug at low temperatures where the alloy is a solid material.

3. The temperature compensated pyrotechnic delay system of claim 2 wherein the metal alloy ring is an eutectic material that is a solid at room temperature.

4. The pyrotechnic delay cartridge system of claim 1 where the volume of the flash chamber is defined by the axial position of the delay plug means.

5. The pyrotechnic delay cartridge of claim 1 where the associated means to restrain the delay plug is a retaining cap.

6. The delay cartridge system of claim 1 where the automatic means is a fusible eutectic alloy.

7. The delay cartridge of claim 6 where the fusible eutectic alloy contains at least one metal selected from the group consisting of bismuth, lead, indium, tin, and cadmium.

8. The delay cartridge of claim 1 wherein the delay column is loaded with three increments of manganese delay.

9. The delay cartridge of claim 8 where the composition of the three increments contain Mn, $PbCrO_4$ and $BaCrO_4$.

* * * * *